US006318345B1

(12) United States Patent
Weber et al.

(10) Patent No.: US 6,318,345 B1
(45) Date of Patent: Nov. 20, 2001

(54) PURGE VAPOR START FEATURE

(75) Inventors: Gregory T. Weber, Commerce Township; Mark J. Duty, Davison, both of MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/377,234

(22) Filed: Aug. 19, 1999

(51) Int. Cl.[7] ..... F02M 33/02
(52) U.S. Cl. ..... 123/520; 123/491; 123/179.16
(58) Field of Search ..... 123/525, 519, 123/520, 516, 576, 578, 491, 179.16

(56) References Cited

U.S. PATENT DOCUMENTS

| | | | | |
|---|---|---|---|---|
| 4,245,592 | | 1/1981 | Atkins, Sr. . | |
| 4,703,736 | | 11/1987 | Atkins, Sr. . | |
| 4,821,701 | | 4/1989 | Nankee, II et al. . | |
| 5,002,596 | | 3/1991 | Moskaitis et al. . | |
| 5,005,550 | | 4/1991 | Bugin, Jr. et al. . | |
| 5,024,687 | | 6/1991 | Waller . | |
| 5,224,456 | * | 7/1993 | Hosoda et al. | 123/520 |
| 5,263,460 | | 11/1993 | Baxter et al. . | |
| 5,275,145 | * | 1/1994 | Tuckey | 123/516 |
| 5,377,644 | * | 1/1995 | Krohm | 123/520 |
| 5,474,047 | * | 12/1995 | Cochard et al. | 123/491 |
| 5,482,023 | * | 1/1996 | Hunt et al. | 123/520 |
| 5,482,024 | * | 1/1996 | Elliott | 123/520 |
| 5,495,749 | | 3/1996 | Dawson et al. . | |
| 5,641,899 | | 6/1997 | Blomquist et al. . | |
| 5,651,349 | | 7/1997 | Dykstra et al. . | |
| 5,682,869 | | 11/1997 | Nankee, II et al. . | |
| 5,875,765 | * | 3/1999 | Norton | 123/516 |
| 5,934,260 | * | 8/1999 | Gadkaree et al. | 123/520 |
| 5,996,562 | * | 12/1999 | Plog et al. | 123/576 |

* cited by examiner

*Primary Examiner*—Thomas N. Moulis
(74) *Attorney, Agent, or Firm*—Mark P. Calcaterra

(57) ABSTRACT

A fuel control system is provided including a fuel tank and a purge vapor collection canister interconnected with an internal combustion engine. A purge vapor canister vent valve selectively seals the purge vapor canister from atmosphere such that the fuel tank, purge vapor canister, and engine intake manifold form a closed system. Upon a cold engine start, a purge valve disposed between the purge vapor canister and the engine intake manifold is opened such that the pressure differential between the engine intake manifold and the remainder of the system causes fuel vapor collected within the dome portion of the fuel tank to be drawn through the purge vapor canister and into the intake manifold. Simultaneously therewith, the amount of fuel injected by the fuel injectors to the engine is reduced such that a desired amount of total fuel delivery is established. As the pressure differential between the intake manifold and the remainder of the closed system changes over time, flow rate of purge vapors from the fuel tank slows down. Commensurate therewith, the amount of injected fuel is increased. During this time the engine is warming up such that the increased amount of injected fuel is more easily vaporized thereby yielding better combustibility. When the engine reaches a fully warm operating condition, the purge vapor valve is closed and complete fuel delivery is provided by the fuel injectors.

16 Claims, 1 Drawing Sheet

PURGE VAPOR START FEATURE

BACKGROUND OF THE INVENTION

1. Technical Field

The present invention generally relates to fuel control systems and, more particularly, to a method of using fuel vapors from the fuel tank to power an engine during cold engine operation.

2. Discussion

Modern automotive vehicle engines commonly employ injected fuel for combustion. At start-up, when the engine is not fully warm, the injected fuel is commonly cold and in a liquid state. Cold fuel, which is not easily vaporized, is less combustible than warm fuel. As such, the liquid fuel poorly combusts at start-up. This may lead to poor emissions.

Attempts have been made before and after combustion to improve emissions quality. One pre-combustion treatment has been to heat the fuel prior to its injection. By heating the fuel, it becomes more easily vaporized thereby improving its combustibility. While successful, such pretreatment heating is complex and expensive to implement. A common post-combustion treatment involves the employment of a catalyst in the engine exhaust gas stream. The catalyst burns the undesirable exhaust gas constituents prior to their passage to the atmosphere. While also successful, such post-combustion treatment is still expensive and complex to implement.

Modern automotive vehicles are also commonly equipped with a fuel vapor purge control system. Fuel within the fuel tank tends to vaporize as temperatures increase. The vaporized fuel collects in the fuel tank and is periodically removed by the purge vapor control system. The fuel vapors from the tank are initially collected and stored in a canister. When the engine operating conditions are conducive to purging, a purge valve is opened thereby allowing the engine to draw the fuel vapors from the purge canister for combustion.

While such purge fuel vapor control systems are very efficient, some fuel vapor is commonly present in the dome portion of the fuel tank at start-up. Advantageously, it has now been discovered that this fuel vapor can be used for combustion during cold engine operation instead of the liquid fuel normally supplied from the fuel injectors.

SUMMARY OF THE INVENTION

A fuel control system is provided including a fuel tank and a purge vapor collection canister interconnected with an internal combustion engine. A purge vapor canister vent valve selectively seals the purge vapor canister from atmosphere such that the fuel tank, purge vapor canister, and engine intake manifold form a closed system. Upon a cold engine start, a purge valve disposed between the purge vapor canister and the engine intake manifold is opened such that the pressure differential between the engine intake manifold and the remainder of the system causes fuel vapor collected within the dome portion of the fuel tank to be drawn through the purge vapor canister and into the intake manifold. Simultaneously therewith, the amount of fuel injected by the fuel injectors to the engine is reduced such that a desired amount of total fuel delivery is established. As the pressure differential between the intake manifold and the remainder of the closed system changes over time, the flow rate of purge vapors from the fuel tank slows down. Commensurate therewith, the amount of injected fuel is increased. During this time the engine is warming up such that the increased amount of injected fuel is more easily vaporized thereby yielding better combustibility. When the engine reaches a filly warm operating condition, the purge valve is closed and complete fuel delivery is provided by the fuel injectors.

BRIEF DESCRIPTION OF THE DRAWINGS

In order to appreciate the manner in which the advantages and objects of the invention are obtained, a more particular description of the invention will be rendered by reference to specific embodiments thereof which are illustrated in the appended drawings. Understanding that these drawings only depict preferred embodiments of the present invention and are not therefore to be considered limiting in scope, the invention will be described and explained with additional specificity and detail through the use of the accompanying drawings in which.

DETAILED DESCRIPTION OF THE PREFERRED EMBODIMENT

The present invention is directed towards a method of fueling an internal combustion engine during cold engine operation. More particularly, the present invention directs fuel vapor from the fuel tank to the intake manifold of the engine immediately after start-up. A commensurate amount of injected fuel is removed during this time so that the appropriate total amount of fuel is delivered to the engine. As the engine warms, less fuel vapor is delivered until finally complete fueling is returned to the fuel injectors.

Figure 1:
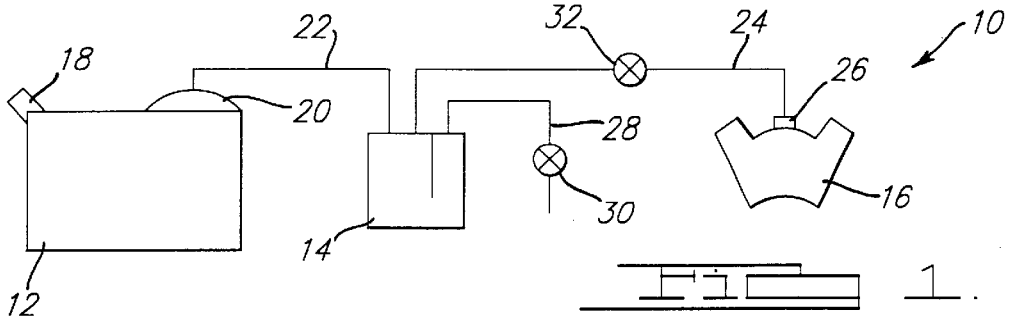
FIG. 1 is a schematic illustration of a purge vapor control system according to the present invention.

Turning now to the drawing figures, a purge vapor control system according to the present invention is illustrated schematically at FIG. 1. The fuel vapor purge control system 10 includes a fuel tank 12, a fuel vapor purge canister 14, and an internal combustion engine 16. The fuel tank 12 includes a fuel fill tube 18 and a dome portion 20. The fuel tank 12 is interconnected with the fuel vapor purge canister 14 by a fuel tank vapor line 22. The fuel tank vapor line 22 is coupled to the dome portion 20 of the fuel tank 12. As is known, fuel vapors in the fuel tank 12 migrate through the tank vapor line 22 and are stored in the fuel vapor purge canister 14.

The fuel vapor purge canister 14 is interconnected with the internal combustion engine 16 by a purge vapor line 24. The purge vapor line 24 is coupled to the intake manifold 26 of the internal combustion engine 16. The fuel vapor purge canister 14 communicates with atmosphere by way of a vent line 28 coupled thereto. A canister vent valve 30 is disposed along the vent line 28 to selectively seal the fuel vapor purge canister 14 from atmosphere. A purge valve 32 is disposed along the purge vapor line 24 for selectively isolating the fuel vapor purge canister 14 and the fuel tank 12 from the internal combustion engine 16.

During normal purging operations, the canister vent valve 30 is open thereby allowing the fuel vapor purge canister 14 to communicate with atmosphere. Also, the purge valve 32, which is typically closed during operation of the internal combustion engine 16, is opened when engine operations are conducive to purging, thereby allowing the lower pressure within the intake manifold 26 to draw purge vapors from the fuel vapor purge canister 14 through the purge vapor line 24 and into the internal combustion engine 16 for combustion.

At start-up, only a small amount of fuel vapors are present in the fuel vapor purge canister 14. In fact, the vast amount of fuel vapors reside in the dome portion 20 of the fuel tank 12 at start-up. By closing the canister vent valve 30 and opening the purge valve 32 at start-up, the low pressure of the intake manifold 26 draws the fuel vapors from the dome portion 20 of the fuel tank 12 into the internal combustion engine 16. As such, this fuel vapor can be used for combustion at start-up instead of the normal injected fuel.

Figure 2:
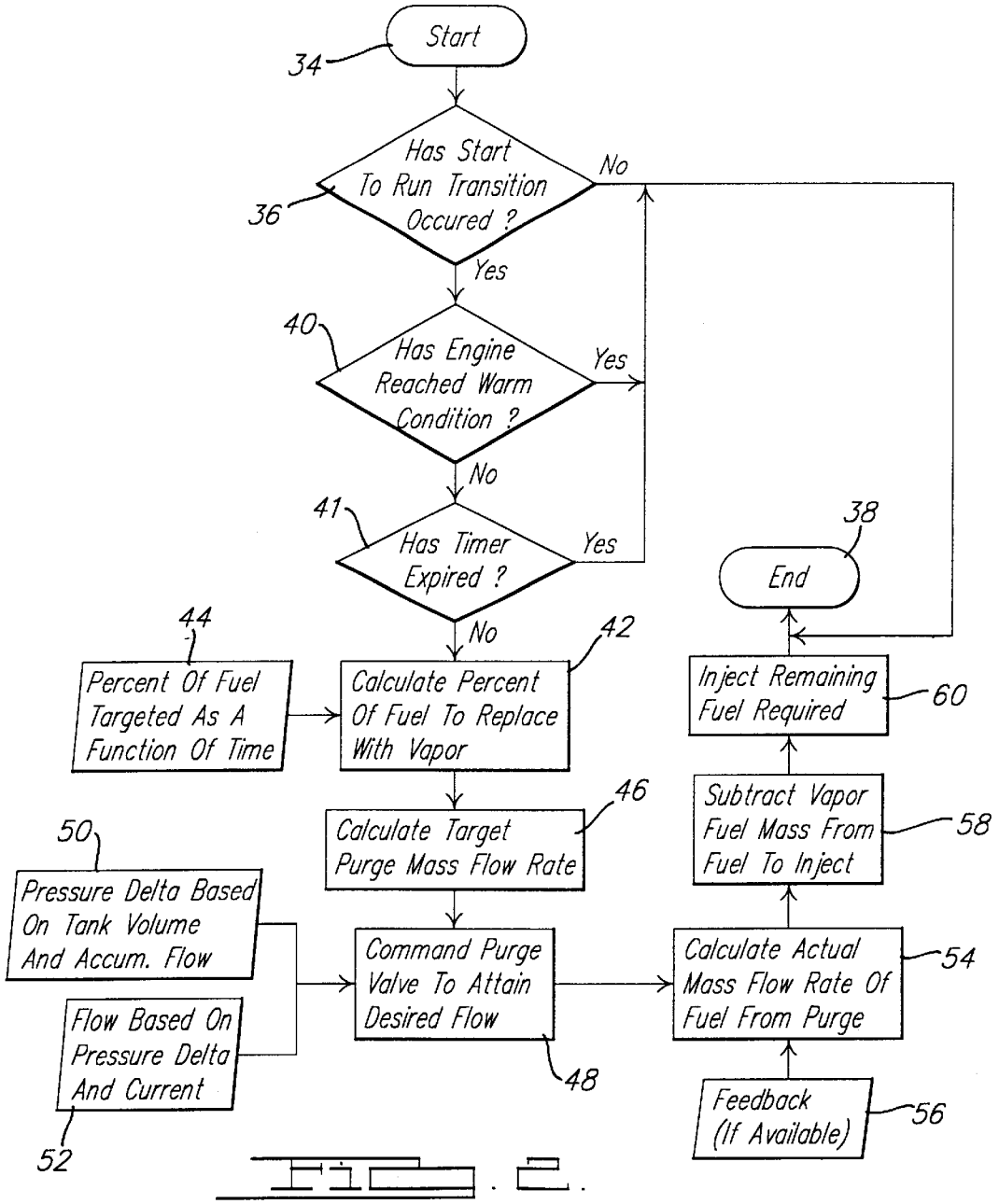
FIG. 2 is a flow chart depicting a control methodology for the purge vapor control system of FIG. 1.

Turning now to FIG. 2, a methodology for controlling the above-described fuel vapor purge system is illustrated. The methodology starts in bubble 34 and falls through to decision block 36. In decision block 36, the methodology determines whether the start-to-run transition of the internal combustion engine has occurred. If not, the methodology advances to bubble 38 and exits the routine pending a subsequent execution thereof. However, if the start-to-run transition has occurred at decision block 36, the methodology continues to decision block 40.

In decision block 40, the methodology determines whether the engine has reached a warm condition. Preferably, this is accomplished by way of a timer although a direct temperature sensor reading may be taken if desired. If the engine has reached a fully warm condition at decision block 40, the methodology advances to bubble 38 and exits the routine pending a subsequent execution thereof. However, if the methodology determines that the engine has not reached a fully warm condition at decision block 40, the methodology continues to block 41.

In block 41, the methodology determines whether a timer has expired. The timer setting corresponds to the predicted period of time that it will take to remove the resident purge vapors from the fuel tank and combust them in the engine. If the fuel tank is relatively full, less room is available in the tank for fuel vapors. As such, less vapor is present and less time is required to remove them. Therefore, the timer is set to expire relatively quickly. On the other hand, if the fuel tank is relatively empty, more room is available in the tank for fuel vapors. As such, more vapor is present and more time is required to remove them. Therefore, the timer is set to expire after a longer period of time.

If the methodology determines that the timer has expired in decision block 41, the methodology advances to bubble 38 and exits the routine pending a subsequent execution thereof. However, if the methodology determines that the timer has not expired in decision block 41, the methodology advances to decision block 42.

In block 42, the methodology calculates the percent of liquid injected fuel to replace with the fuel vapor from the fuel tank. Data block 44 dictates that the percent of fuel to be replaced is targeted as a function of time since start-up. The desired percentage of fuel vapor to be provided is preferably the maximum amount within certain limits. For instance, at idle, a minimum pulse width requirement sets the maximum limit. The minimum pulse width sets the minimum amount of fuel that can be accurately delivered by the fuel injectors depending on the operating parameters of the engine. Preferably, the fuel injectors are never completely turned off to avoid transient fuel concerns at a throttle tip-in event. During off idle conditions, a maximum rate of flow from the fuel tank is the maximum limit. From block 42, the methodology continues to block 46.

In block 46, the methodology calculates the target purge fuel vapor mass flow rate. As described above, the target purge mass flow rate is that amount of fuel vapor required to replace the injected fuel calculated to be removed at block 42. From block 46, the methodology continues to block 48.

In block 48, the methodology commands the purge valve to open such that a desired amount of purge fuel vapor mass flow is attained. Over time, the pressure difference between the intake manifold and the fuel tank changes. As such, the rate of flow between the fuel tank and the intake manifold changes. Data block 50 dictates that the pressure change is based on tank volume and accumulated flow. Data block 52 dictates that the rate of flow change is based on the pressure change and the current rate of flow. Conveniently, the pressure change in data block 50 and the purge flow in data block 52 can be mapped in a pair of tables as a function of time. From block 48, the methodology continues to block 54.

In block 54, the methodology calculates the actual mass flow rate of the fuel from the purge system. Data block 56 provides feedback to this calculation if it is available. For instance, a fuel modifier from a dynamic crankshaft fuel control system could be input here to further vary the fueling strategy. After calculating the actual mass flow rate of the fuel from the purge system at block 54, the methodology continues to block 58. In block 58, the methodology subtracts the amount of vapor fuel mass calculated at block 54 from the amount of fuel to inject. From block 58 the methodology continues to block 60.

In block 60, the methodology injects the amount of fuel calculated at block 58. As can be appreciated, as the mass flow rate of fuel vapor from the fuel tank decreases, the amount of fuel required to be injected at block 60 increases. When the mass flow rate of the purge fuel vapors drops below a minimum threshold, complete fuel delivery is supplied by the fuel injectors. By this time, the intake valve and manifold port of the engine should be warm thereby heating the injected liquid fuel such that it is efficiently vaporized resulting in improved emissions. From block 60, the methodology continues to bubble 38 where it exits the routine pending a subsequent execution thereof.

Thus, a fuel control system is provided for fueling an internal combustion engine with fuel vapors from the fuel tank at start-up. In combination therewith, a reduced amount of fuel is injected into the engine. As the engine warms up, the ratio of fuel vapor to injected fuel changes such that engine operation eventually transitions completely to injected fuel. Advantageously, cold engine operation is primarily based on fuel vapors thereby eliminating poor emissions which may accompany the combustion of cold injected fuel.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and following claims.

What is claimed is:

1. A method of fueling an internal combustion engine comprising:

determining a cold engine operating condition to exist;

delivering a first quantity of fuel consisting of fuel vapors from a dome portion of a fuel tank to said engine for combustion during said cold engine operating condition; and delivering a second quantity of fuel consisting of liquid fuel from a fuel injection system to said engine for combustion with said fuel vapors during said cold engine operating condition, said second quantity of fuel being proportional to said first quantity of fuel such that a desired total quantity of fuel is delivered to said engine.

2. The method of claim 1 wherein said step of determining said cold engine operating condition to exist further comprises detecting a start-up event of said engine.

3. The method of claim 1 wherein said step of delivering said first quantity of fuel consisting of fuel vapors from said dome portion of said fuel tank further comprises establishing a pressure difference between said engine and said fuel tank.

4. The method of claim 3 wherein said step of establishing said pressure difference further comprises sealing said fuel tank from atmosphere.

5. The method of claim 4 wherein said step of sealing said fuel tank from atmosphere further comprises closing a valve disposed on a vent line coupled to a fuel vapor purge canister communicating with said fuel tank.

6. The method of claim 1 wherein said step of delivering a second quantity of fuel consisting of liquid fuel from a fuel injection system to said engine further comprises monitoring said first quantity fuel delivered to said engine from said fuel tank and reducing said second quantity of fuel a commensurate amount.

7. The method of claim 6 wherein said step of monitoring said first quantity of fuel delivered to said engine further comprises determining a mass flow rate of said fuel vapor to said engine over time.

8. A method of fueling an internal combustion engine through use of a fuel vapor purge control system including a fuel tank and a fuel vapor canister comprising:

detecting a start-up event of said engine;

determining a fuel level in said fuel tank;

predicting an amount of fuel vapor present in said fuel tank based on said fuel level;

setting a timer to a value corresponding to a period of time required for said amount of fuel vapors to be removed from said fuel tank;

sealing said fuel tank and fuel vapor canister from atmosphere;

establishing a pressure difference between said fuel tank and said engine; drawing fuel vapors from a dome portion of said fuel tank to said engine; and stopping said drawing of fuel vapors from said fuel tank to said engine at an expiration of said timer.

9. The method of claim 8 further comprising:

monitoring an amount of said fuel vapors delivered to said engine; and injecting an amount of fuel into said engine proportional to said fuel vapors such that a desired total amount of fuel is delivered to said engine.

10. The method of claim 8 wherein said step of sealing said fuel tank and fuel vapor canister from atmosphere further comprises closing a valve disposed on a vent line coupled to said fuel vapor canister.

11. The method of claim 8 wherein said step of establishing a pressure difference between said fuel tank and said engine further comprises opening a valve between an intake manifold of said engine and said fuel tank.

12. The method of claim 8 further comprising:

reducing an amount of said fuel vapors being drawn into said engine over time; and increasing an amount of fuel being injected into said engine commensurate with said reducing of said amount of said fuel vapors.

13. A method of fueling an internal combustion engine comprising:

providing a fuel vapor purge system including:

a fuel vapor purge canister interconnected to said engine by a purge line;

a purge valve disposed on said purge line;

a vent line coupled to said fuel vapor purge canister and communicating with atmosphere;

a vent valve disposed on said vent line; and a fuel tank interconnected to said fuel vapor purge canister by a vapor line;

detecting a start-up event of said engine;

closing said vent valve on said vent line to isolate said fuel tank from atmosphere;

opening said purge valve on said purge line to establish a pressure difference between said engine and said fuel tank;

drawing fuel vapors from said fuel tank through said vapor line, fuel vapor purge canister, and purge line to said engine;

monitoring an amount of said fuel vapors drawn to said engine;

injecting an amount of fuel to said engine commensurate with said amount of said fuel vapors drawn to said engine; and combusting said fuel vapors and said injected fuel in said engine.

14. The method of claim 13 wherein said step of monitoring said amount of said fuel vapors drawn to said engine further comprises:

determining changes in said pressure difference; and determining changes in a mass flow rate of said fuel vapors to said engine.

15. The method of claim 13 further comprising:

decreasing an amount of said fuel vapors being drawn into said engine over time; and increasing an amount of fuel being injected into said engine commensurate with said decrease in said amount of said fuel vapors.

16. The method of claim 13 further comprising:

determining a fuel level in said fuel tank;

predicting an amount of fuel vapors present in said fuel tank based on said fuel level;

setting a timer for said amount of fuel vapors to be removed from said fuel tank corresponding to said amount of fuel vapors; and closing said purge valve on said purge line to remove said pressure difference between said engine and said fuel tank at an expiration of said timer.

* * * * *